United States Patent [19]

Schaupert

[11] Patent Number: 5,024,209

[45] Date of Patent: Jun. 18, 1991

[54] GAS COOKING APPLIANCE WITH AT LEAST ONE RADIANT GAS BURNER ARRANGED UNDERNEATH A GLASS CERAMIC PLATE, AS WELL AS PROCESS FOR REDUCING THE HEATING-UP TIME OF SUCH A GAS COOKING APPLIANCE

[75] Inventor: Kurt Schaupert, Hofheim-Wallau, Fed. Rep. of Germany

[73] Assignee: Schott Glaswerke, Mainz, Fed. Rep. of Germany

[21] Appl. No.: 508,616

[22] Filed: Apr. 13, 1990

[30] Foreign Application Priority Data

Apr. 13, 1989 [DE] Fed. Rep. of Germany ..... 3912124

[51] Int. Cl.[5] ..... F24C 3/00

[52] U.S. Cl. ..... 126/39 H; 126/39 J; 126/39 R; 431/62

[58] Field of Search ..... 126/39 H, 39 G, 39 J, 126/39 BA, 39 R; 337/298, 398; 431/23, 62, 63, 67, 79, 90

[56] References Cited

U.S. PATENT DOCUMENTS

| | | | |
|---|---|---|---|
| 3,606,612 | 10/1969 | Reid, Jr. | 126/39 J X |
| 4,083,355 | 4/1978 | Schwank | 126/39 J |
| 4,201,184 | 5/1980 | Scheidler et al. | 126/39 J |
| 4,267,815 | 5/1981 | Gössler | 126/39 H |
| 4,374,319 | 2/1983 | Guibert | 126/21 A X |
| 4,646,963 | 3/1987 | Delotto et al. | 126/39 G X |

*Primary Examiner*—Larry Jones

*Attorney, Agent, or Firm*—Millen, White & Zelano

[57] ABSTRACT

In order to accelerate the heating of a burner plate of a cooking appliance with a glass ceramic cooking surface and a radiant gas burner, the radiant gas burner is operated during the heating-up phase with an increased quantity of gas. The gas quantity is throttled to the normal rate at the latest upon reaching the operating temperature in the full load position. The time of throttling can either be predetermined by a time control or by determining the temperature of the burner plate. The gas quantity is throttled to achieve a predetermined temperature.

15 Claims, 2 Drawing Sheets

FIG. 1
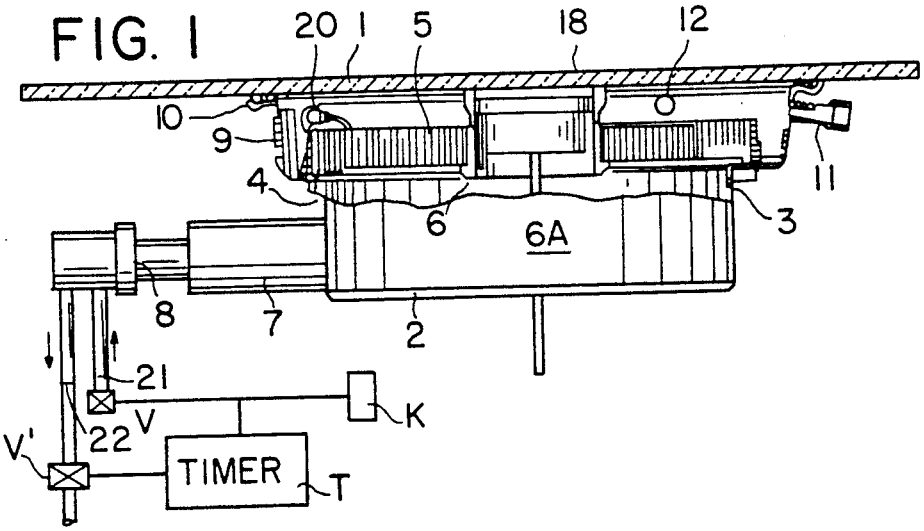
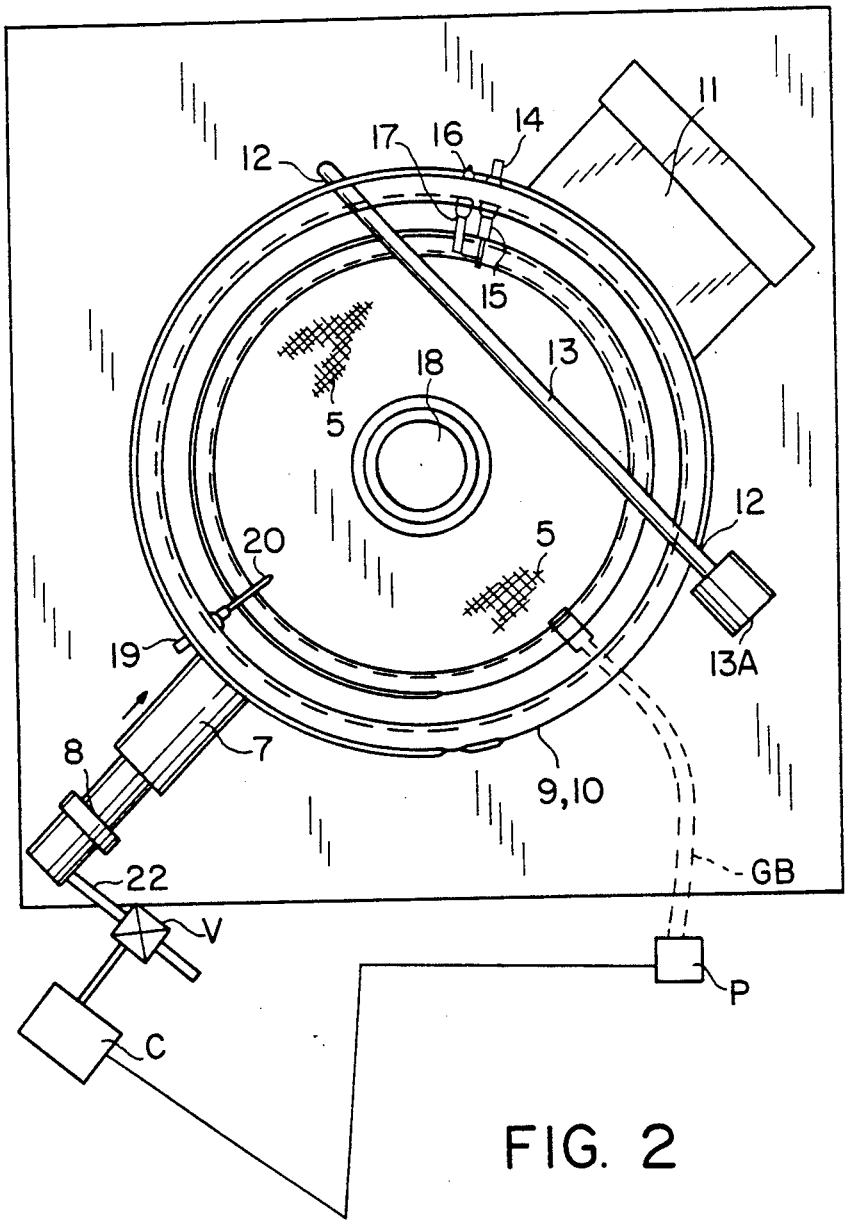
FIG. 2

GAS COOKING APPLIANCE WITH AT LEAST ONE RADIANT GAS BURNER ARRANGED UNDERNEATH A GLASS CERAMIC PLATE, AS WELL AS PROCESS FOR REDUCING THE HEATING-UP TIME OF SUCH A GAS COOKING APPLIANCE

BACKGROUND OF THE INVENTION

The invention relates to a gas cooking appliance with at least one radiant gas burner arranged underneath a glass ceramic cooking plate, the gas burner being leakproof with respect to exhaust gas, with a burner plate, control devices for gas supply, ignition and safety devices, as well as monitoring devices for monitoring the temperature of the cover. The invention further relates to a process for reducing the time for heating up such gas cooking appliances.

Gas cooking appliances with radiant gas burners and glass ceramic cooking plates have been disclosed in numerous patents, for example, in U.S. Pat. No. 3,468,298, DOS 2,621,801, U.S. Pat. No. 4,083,355, and U.S. Pat. No. 4,201,184. In radiant gas burners, gas is combusted on the surface of a burner plate made of a porous ceramic material. In a gas cooking appliance, one or several such radiant gas burners are arranged at a spacing underneath a joint conventional glass ceramic plate, a cooking unit being formed by each burner on the top-side of the glass ceramic plate. Each individual radiant gas burner is provided with an ignition device and with an ignition safety device for preventing ignition of any fuel gas mixture which flows away unconsumed. A description of such a burner plate is found, for example, in EP-A 187,508.

Depending on the temperature resistance of the material, the temperature of the radiant burner plate ranges between about 900° C. and 950° C. The amount to be maximally fed to the burner is restricted by design features in such a way that a maximum operating temperature is not exceeded in order to protect the material of the burner plate and the cooking surface, and in order to avoid superfluous energy losses.

The permissible maximum temperature of glass ceramic cooking surfaces is usually in the range of about 700° C. to 750° C. Since, in case of pots having unsuitable bottoms or in case of an unoccupied cooking unit with high power being turned on, temperatures of 900° C. and above can occur within a short time in the glass ceramic cooking plate, a temperature limiter is provided in order to protect the glass ceramic cooking plate. The limiter safely prevents such excess temperatures. Such temperature limiters are described in detail, for example, in DOS 2,621,801 and U.S. Pat. No. 4,201,184.

For practical use in heating a cooking surface, a regulation or control of the power of the burner must be provided in addition to limiting the temperature. Two principles are known for power control: on the one hand, the burner is operated continuously and the amount of gas supplied is reduced or increased in correspondence with the required power and, on the other hand, the burner is operated in a timed fashion, i.e., the burner is always operated with the maximum amount of gas, and the required power results from the ratio of turned on time to turned off time (cyclic ratio). Instead of a mere power control with amounts of gas or timing ratios fixedly predetermined for the individual power stages, it is also possible to provide a power regulation wherein a temperature sensor regulates the power output in dependence on the cooking unit temperature, as it is described in detail, for example, in U.S. Pat. No. 4,201,184.

Although the previous gas cooking appliances with radiant gas burners have been the subject of numerous improvements, an unresolved problem still resides in that a relatively long period of time passes between turning the burner on and the burner plate becoming red hot and thus also becoming visible, with the burner delivering full power (about 60 seconds; compare U.S. Pat. No. 4,130,104).

SUMMARY OF THE INVENTION

It is an object of the invention to provide a gas cooking appliance having a radiant gas burner and a glass ceramic cooking plate wherein the heating-up time of the burner plate after it has been turned on is substantially shortened, and furthermore to provide a process for reducing the heating-up time in a gas cooking appliance of the aforementioned type.

Accordingly, the principle of the invention resides in feeding to the burner, during its heating-up phase, i.e., after it has been turned on (ignited) or during the switching to full load, an extra amount of gas which would ordinarily cause the cooking unit to overload with respect to temperature if allowed to continue. The extra amount of gas being such that a high temperature exceeding the maximum temperature permissible for the ceramic of the burner plate or the cooking surface would occur, or that unduly high energy losses would occur. This increased amount of gas, however, is harmless as long as the permissible maximum temperature in normal operation is not exceeded. As soon as the temperature reaches this threshold, suitable measures and/or devices are employed to ensure that the amount of gas is throttled back to such an extent so that components of the burner do not exceed their permissible maximum operating temperature as in a conventional gas cooking appliance. This throttling action can consist, for example, in closing an auxiliary valve through which an additional quantity of gas is added to the normal gas stream. Another possibility resides in designing the entire gas feeding system for the increased amount of gas and throttling the gas stream in such case by activating a shutter or the like.

Throttling must be effected at the latest at a point in time when the operating temperature of the cooking unit has been reached at full load. The operating temperature at full load can vary within certain limits permitted by the manufacturer of the cooking appliance, in dependence on the cooking conditions (e.g., pot quality, pot size, amount of food being cooked). For example, a simple time control can be activated upon ignition of the burner and/or when the burner is switched to full load.

The burner is supplied with the increased amount of gas for a fixedly predetermined time period and, after this time has elapsed, the gas stream is again throttled to the normal quantity. The time control can be provided in a particularly economical fashion and operates satisfactorily even when the burner plate is still hot at activation of the time control since the radiant output with increasing temperature of the burner plate rises very greatly. Therefore, the temperature rise in the upper power range of the burner is no longer so fast that the predetermined time has elapsed before temperatures occur which are destructive to the burner plate. It is also possible to utilize the position of the controller for the gas quantity to regulate the time within which the excess amount of gas is supplied. For example, starting with a partial load position, the time during which the burner is operated with the increased gas quantity is shortened. When switching to full load, the higher the partial load position is attained before onset of the full load position.

The time within which the burner can be operated with increased gas feed until the operating temperature has been reached upon full load depends on the temperature to be attained, on the calorific value of the gas, and on the increased amount of gas fed to the burner. This can be readily determined experimentally. Usually this time period ranges between about 5 and 60 seconds. A time of less than 20 seconds, especially less than 10 seconds, within which the burner plate shows visible red heat, is preferred.

It is known to a person skilled in the art that the amount of gas supplied to the burner and/or the gas/air mixture proportional to the amount of gas cannot be chosen to be arbitrarily high because combustion must take place in the surface and, respectively, in the pores of the ceramic burner plate. If the amount of gas is too high, the flow rate becomes so high in the pores and bores of the burner plate that the flame front migrates from the burner plate and the burner no longer radiates. The quantity of gas or of gas/air mixture fed maximally to the burner must, therefore, be chosen so that the combustion still takes place within the burner plate. In this connection, it is advantageous for obtaining rapid heating of the burner plate to select the amount of gas to be as large as possible. Usually, the quantity of gas additionally supplied to the burner is about 10–40% of the amount of gas maximally permissible during continuous operation of the burner; in special burner plates, as known, for example, from EP-OS 187,508, this factor can also be higher.

The second possibility for determining the instant of throttling of the gas quantity resides in determining the temperature of the surface of the burner plate and throttling the gas stream when a predetermined temperature of the burner plate has been reached. Measurement of the temperature can be performed by conventional means, thus, for example, by a thermocouple, e.g. Pt/Ir elements arranged in, on, or above the surface of the burner plate on the exhaust gas side, i.e., on the hot surface, or by an electrical resistor, by an expansion element, or by measuring the radiation emanating from the burner plate, especially by measuring the color temperature or the radiation intensity. Radiation measurement has the advantage that the actual measuring cell, for example a photodiode, a phototransistor or a photoelectric element, need not have any direct contact with the hot surface of the burner plate. In an especially advantageous fashion, the radiation measuring cell is arranged at a relatively cool location of the cooking appliance, and the radiation emanating from the burner plate is conducted to the measuring cell by means of a fiber-optic device, for example a glass fiber or a glass fiber bundle.

With a suitable arrangement of the temperature sensor for the ignition safety means within or directly on the surface of the burner plate on the exhaust gas side, the temperature sensor can optionally also take over the monitoring of the temperature of the burner plate.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein:

FIG. 1 shows, in a schematic view, a vertical cutaway sectional view of a gas cooking appliance with a radiant burner;

FIG. 2 is a top view of the sectional view according to FIG. 1; and

DETAILED DESCRIPTION

Figure 3:
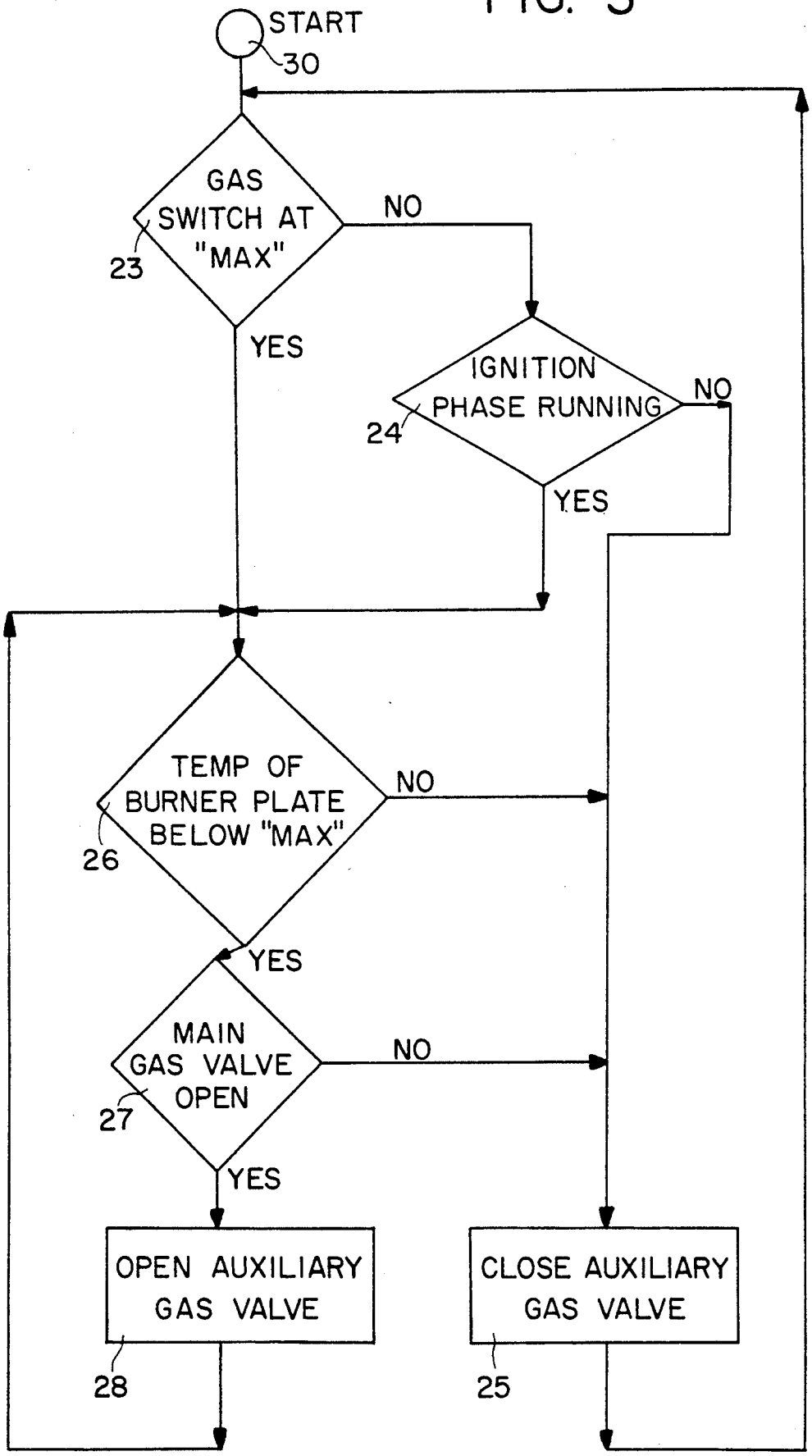
FIG. 3 is a flow diagram of an electronic control for a gas cooking appliance with control of the additional amount of gas by way of temperature measurement of the burner plate.

FIGS. 1 and 2 show a glass ceramic cover 1 serving as a cooking surface. Underneath the cover 1, an infrared radiant heating element 2 is located with a housing 3 that can consist of metal with a porous (perforated) burner plate 5 which is positioned above the open top part of housing 3, for example by means of clamps. the housing 3 and the burner plate 5 form the burner space 4. The burner plate 5 is usually round and can have a central opening 6. On the sidewall of housing 3, the gas mixture pipe 7 is in communication with the burner space 4; the other end of the mixture pipe 7 is connected to the gas nozzle 8. The gas nozzle 8 is connected with two gas feed pipes 21 and 22 of which the gas feed pipe 21 (main gas line) serves for supplying the amount of gas required for normal operation of the burner. The gas feed pipe 22 (auxiliary gas line) yields the additional quantity of gas needed for the heating-up phase. An exhaust gas ring 9, made of a metal, for example, circularly surrounds the burner plate 5. The ring 9 is attached by means of a circular, inwardly bent lip to the upper end of the housing 3, for example by welding. The upper circular end of the exhaust gas ring 9 is shaped so that it can be resiliently urged against the cover 1 by way of an elastic, temperature resistant sealing ring 10. An oblong opening is provided in the exhaust gas ring 9, the exhaust gas connecting pipe 11 being connected to this opening. The exhaust gas ring 9 furthermore comprises a hole 12 for the accommodation of a temperature limiter which in the illustrated form is a rod-shaped expansion element 13 with switch 13A. This temperature limiter serves for protecting the glass ceramic cover plate 1. The openings 14 and 16 serve for the accommodation of an ignition means, for example a spark plug 15 and/or a temperature sensor 17 as the ignition safety. The function of temperature limiters, ignition devices, and ignition safety means are known to those skilled in the art and will not be described in greater detail. The central opening 6 of the burner plate 5 is equipped with a ceramic pipe 6A wherein a thermal probe 18 is arranged. This thermal probe 18 serves for power regulation and permits fully automatic cooking. The function of such a regulator is likewise well known and will not be explained in detail.

The opening 19 in the exhaust gas ring 9 serves for accommodating a further thermal probe 20 which is in direct contact with the surface of the burner plate 5 on the exhaust gas side. As soon as the temperature sensor 20, heated by the burner plate 5, detects the predetermined maximum temperature for the burner plate 5, the additional gas stream flowing through conduit 22 is shut off. Overheating of the burner plate 5 is thereby avoided. The illustration does not include details of switches, valves, wiring, or electrical devices since these parts consist of conventional components obtainable commercially and have been part of the state of the art for a long time. The temperature sensor 13 as well as the temperature sensor 20 can optionally be designed so that they have two switching points in such a way that a lower switching point transmits the desired signal for the ignition safety means and the upper switching point serves for the desired temperature limitation. In this way, the temperature sensor 17 for the ignition fuse can be omitted. In a conventional manner, a timer T closes a valve V in the supplemental feed line 22. The timer T is started in a conventional manner by the control knob K, which, when turned fully on to open valve V in gas feed line 21, also completely opens valve V and starts the timer, which closes the valve V upon completion of the selected time period.

FIG. 3 shows a flow chart illustrating an example for the sequence of the individual steps in a process of controlling the added quantity of gas by way of a temperature sensor on the burner plate. The individual blocks in FIG. 3 represent operative steps as well as devices for the performance of such steps. When a heating element is turned on, the program is started at starting point 30. Next, a determination is made in unit 23 as to whether or not the power control switch (gas switch) is at "maximum". If this is not the case, then unit 24 checks whether the burner is still in the ignition (starting) phase. If this is not the case, either, then the gas valve for the additional amount of gas (conduit 22, FIG. 2) is closed by means of unit 25, or remains closed. Unit 25 transfers control again to unit 23. If the power control switch (gas switch) is set at "maximum" control is transferred to unit 26, and this is also done if unit 24 determines that the ignition (starting) phase prevails. Unit 24 is provided to be able to attain as quickly as possible a burner effect even when ignition takes place under reduced power.

Unit 26 determines whether the temperature of the burner plate is still below maximum temperature. If this is not the case, then unit 25 closes the valve for the additional amount of gas, or the valve remains closed, and control is again resumed by unit 23. If the temperature of the burner plate is below the maximally permissible temperature of the burner plate, unit 27 conducts a checking step whether the valve for the main gas line (conduit 21, FIG. 1) is opened. If this is not the case, then opening the auxiliary gas valve would not make any sense, either, the auxiliary gas valve is closed by means of unit 25, and control is again transferred to unit 23. However, if the main gas valve is opened, then unit 28 opens the auxiliary gas valve, and control is transferred to unit 26. The loop formed of units 26, 27 and 28 is traversed until either the burner plate has reached its maximum temperature or until the main gas valve is closed.

As is seen in FIG. 2, a fiber optic bundle GB has one end in proximity to the burner plate 5 and the other connected to a photodiode P. The photodiode P in a conventional manner acts as a measuring cell, which converts color temperature or radiation intensity to a signal, causing a controller C to close valve V in supplemental gas feed line 22 when the temperature reaches a preselected level.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

The entire disclosures of all applications, patents and publications, if any, cited above and below, and of corresponding application Federal Republic of Germany P 39 12 124.0, filed Apr. 13, 1989, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A gas cooking appliance with at least one radiant gas burner having an exhaust gas side, the burner being positioned underneath a glass ceramic plate with a burner plate having a single combustion chamber, the appliance including a gas supply controller as well as customary ignition, safety, and temperature monitoring devices, the improvement comprising: a supplemental gas feed means activated when the appliance is switched on and when the gas supply controller is positioned at full load, the supplemental gas feed means feeding the single combustion chamber of the burner with an increased amount of gas that exceeds the amount of gas normally fed in a full load position of the gas controller; and means for deactivating the supplemental gas feed means upon the ceramic plate reaching the predetermined temperature to interrupt the flow of gas therethrough.

2. The gas cooking appliance of claim 1, wherein the means for deactivating the supplemental gas feed means comprises a timer connected to the supplemental gas feed means for cutting off the supplemental gas feed means upon passing of a selected time period to stop the feeding of the increased amount of gas to the burner.

3. The gas cooking appliance according to claim 2, wherein the increased amount of gas is cut off after a time period in the range of 5 to 20 seconds.

4. The gas cooking appliance according to claim 3, wherein the time period is in the range of about 5 to less 10 seconds.

5. The gas cooking appliance of claim 1, wherein the means for deactivating the supplemental gas feed means comprises a temperature measuring device in proximity with the burner plate and connected to the supplemental gas feed means for deactivating the supplemental gas feed means when the temperature sensed by the temperature measuring device reaches a preselected level.

6. The gas cooking appliance according to claim 5, wherein the temperature measuring device is a thermocouple located in proximity to the surface of the burner plate on the exhaust gas side.

7. The gas cooking appliance according to claim 6, wherein the radiation meter is connected to one end of an optical fiber, the other end of the optical fiber being oriented toward the burner plate.

8. The gas cooking appliance according to claim 1, wherein the temperature measuring device is a radiation meter oriented toward the surface of the burner plate on the exhaust gas side.

9. The gas cooking appliance according to claim 1, wherein the temperature measuring device is an expansion element positioned above the surface of the burner plate on the exhaust gas side.

10. A process for reducing the heating-up time of a gas cooking appliance having at least one radiant gas burner with a single combustion chamber, a glass ceramic cooling plate, and customary power and safety devices, the process comprising: after ignition and during switching to full load, feeding the single combustion chamber of the burner with an amount of gas increased with respect to full load in normal operation and capable of damaging the glass ceramic cooking plate until the operating temperature of the burner plate has been reached and thereafter stopping the feed of the amount of gas.

11. The process according to claim 10, wherein the increased amount of gas is controlled so that red heat of the burner plate is attained in a timer period of about 5 to less than 20 seconds.

12. The process of claim 11, wherein the time period is in the range of about 5 to less than 10 seconds.

13. The process according to claim 10, wherein the time period within which the burner is fed with the increased amount of gas is fixedly predetermined by means of a time control unit.

14. The process according to claim 10, wherein the temperature of the surface of the burner plate on the exhaust gas side is monitored.

15. The process according to claim 14, wherein the temperature is determined by means of a thermocouple located in proximity to the surface of the glass cooking plate.

* * * * *